US008062005B2

(12) United States Patent
Hansen et al.

(10) Patent No.: US 8,062,005 B2
(45) Date of Patent: Nov. 22, 2011

(54) LINEAR COMPRESSOR WITH SPRING ARRANGEMENT FOR VIBRATION SUPPRESSION

(75) Inventors: Poul Erik Hansen, Sydals (DK); Jan Thomsen, Aabenraa (DK); Frank Holm Iversen, Padborg (DK)

(73) Assignee: Secop GmbH, Flensburg (DE)

( * ) Notice: Subject to any disclaimer, the term of this patent is extended or adjusted under 35 U.S.C. 154(b) by 1082 days.

(21) Appl. No.: 11/501,358

(22) Filed: Aug. 9, 2006

(65) Prior Publication Data

US 2007/0041855 A1 Feb. 22, 2007

(30) Foreign Application Priority Data

Aug. 17, 2005 (DE) ..... 10 2005 038 780

(51) Int. Cl.
*F04B 35/00* (2006.01)
*F04B 17/03* (2006.01)

(52) U.S. Cl. ..... 417/363; 417/417

(58) Field of Classification Search ..... 417/363, 417/417, 474, 475, 476, 477.1, 477.3, 477.4, 417/477.5, 477.6, 477.7, 477.8, 477.9, 477.11, 417/477.12, 477.13, 477.14, 478, 416; 248/603, 248/604, 605, 569, 570, 581, 587, 602, 610, 248/611, 628

See application file for complete search history.

(56) References Cited

U.S. PATENT DOCUMENTS

| | | | | |
|---|---|---|---|---|
| 1,832,368 | A * | 11/1931 | Ell | 248/603 |
| 2,977,043 | A * | 3/1961 | Scheldorf | 417/363 |
| 3,300,125 | A * | 1/1967 | Winkler | 417/363 |
| 3,597,122 | A * | 8/1971 | Farmer | 417/417 |
| 4,365,791 | A * | 12/1982 | Orain et al. | 267/166 |
| 5,649,812 | A * | 7/1997 | Schoenmeyr et al. | 417/363 |
| 5,772,410 | A | 6/1998 | Chang | |
| 5,944,302 | A * | 8/1999 | Loc et al. | 267/180 |
| 6,092,999 | A * | 7/2000 | Lilie et al. | 417/415 |
| 6,193,225 | B1 * | 2/2001 | Watanabe | 267/180 |
| 6,565,332 | B2 | 5/2003 | Kawahara et al. | |
| 6,641,377 | B2 * | 11/2003 | Toyama et al. | 417/417 |
| 6,729,861 | B2 * | 5/2004 | Oh et al. | 417/417 |
| 6,742,998 | B2 * | 6/2004 | Kawahara et al. | 417/416 |
| 6,793,470 | B2 | 9/2004 | Song et al. | |
| 6,881,042 | B2 | 4/2005 | Heo et al. | |
| 7,056,102 | B2 * | 6/2006 | Cremer et al. | 417/363 |
| 7,153,108 | B2 * | 12/2006 | Puff et al. | 417/417 |
| 2004/0047751 | A1 | 3/2004 | Kim et al. | |

(Continued)

FOREIGN PATENT DOCUMENTS

DE 1 628 174 A1 5/1971

(Continued)

*Primary Examiner* — Devon C Kramer
*Assistant Examiner* — Nathan Zollinger
(74) *Attorney, Agent, or Firm* — McCormick, Paulding & Huber LLP

(57) ABSTRACT

The invention concerns a linear compressor, particularly a refrigerant compressor, with a housing (2, 2') and a compression unit, which comprises a compressor with a piston and a cylinder as well as a linear motor driving the piston in relation to the cylinder along a movement axis, the compression unit (30) being connected to the housing (2) via a spring arrangement (7). It is endeavoured to provide a space saving support of the compression unit (30) in the housing that enables good vibration suppression. For this purpose, the spring arrangement comprises a spring (6, 7), which is curved in the circumferential direction in relation to the movement axis (50), said spring surrounding the compression unit (3-5) on at least a share of its circumference.

16 Claims, 6 Drawing Sheets

U.S. PATENT DOCUMENTS

| | | | | |
|---|---|---|---|---|
| 2004/0245862 | A1 | 12/2004 | Hong et al. | |
| 2005/0158193 | A1 * | 7/2005 | Roke et al. | 417/417 |
| 2005/0175473 | A1 * | 8/2005 | Park et al. | 417/363 |
| 2007/0020122 | A1 * | 1/2007 | Halkyard et al. | 417/363 |
| 2007/0040456 | A1 | 2/2007 | Hansen et al. | |
| 2007/0041854 | A1 | 2/2007 | Hansen et al. | |

FOREIGN PATENT DOCUMENTS

| | | | |
|---|---|---|---|
| DE | 1 628 175 | | 7/1971 |
| DE | 1628175 | | 7/1971 |
| DE | 2441604 | | 3/1976 |
| EP | 1 433 955 | A1 | 6/2004 |
| GB | 1 222 425 | | 2/1971 |
| GB | 1222425 | | 2/1971 |
| JP | 11117861 | A * | 4/1999 |
| WO | 02/06698 | A1 | 1/2002 |
| WO | WO 02/06698 | A1 | 1/2002 |
| WO | 2005/033509 | A1 | 4/2005 |

* cited by examiner

LINEAR COMPRESSOR WITH SPRING ARRANGEMENT FOR VIBRATION SUPPRESSION

CROSS-REFERENCE TO RELATED APPLICATIONS

Applicant hereby claims foreign priority benefits under U.S.C. §119 from German Patent Application No. 10 2005 038 780.2 filed on Aug. 17, 2005, the contents of which are incorporated by reference herein. This Application relates to German Patent Applications No. 10 2005 038 783.7 (Attorney Docket No. 6495-0168); No. 10 2005 038 784.5 (Attorney Docket No. 6495-0169); No. 10 2005 038 785.3 (Attorney Docket No. 6495-0170); No. 10 2005 038 781.0 (Attorney Docket No. 6495-0172), filed on the same date herewith.

FIELD OF THE INVENTION

The invention concerns a linear compressor, particularly a refrigerant compressor, with a housing and a compression unit, which comprises a compressor with a piston and a cylinder as well as a linear motor driving the piston in relation to the cylinder along a movement axis, the compression unit being connected to the housing via a spring arrangement.

BACKGROUND OF THE INVENTION

During operation, the reciprocating piston causes oscillations in the compression unit. It is desired to decouple these oscillations from the housing in order to keep the noise generation outside the housing small.

Therefore, it is known from U.S. Pat. No. 6,881,042 B2 to support the compression unit of a linear compressor on the bottom of the housing via several helical springs. The helical springs cause a decoupling with regard to oscillations between the compression unit and the housing, so that outside the housing the oscillations are detectable only to a very limited extent.

However, such helical springs require relatively much space between the housing and the compression unit, so that dimensions of the housing will inevitably be increased. When such a compressor is used as refrigerant compressor in a domestic refrigeration appliance, for example a refrigerator or a freezer, the space required for the housing will no longer be available volume for storing goods to be cooled. Further, the helical springs have the disadvantage that perpendicular to their screw axis they can only provide a relatively poor damping. This, however, is exactly the direction, in which the reciprocating piston causes oscillations.

BRIEF SUMMARY OF THE INVENTION

The invention is based on the task of providing a space saving supporting of the compression unit in the housing, which ensures good vibration damping properties.

With a linear compressor as mentioned in the introduction, this task is solved in that the spring arrangement comprises a spring, which is curved in the circumferential direction in relation to the movement axis, said spring surrounding the compression unit on at least a share of its circumference.

In directions lying in the plane of its curve, the spring has a relatively large rigidity. These directions substantially correspond to the cross-section of the compression unit. Accordingly, the risk is small that the spring will be too heavily deformed in a direction, in which the compression unit could strike against the inside of the housing. Due to the rigidity of the spring, given forces will namely only cause very small deflections in this direction. In a perpendicular direction, which is parallel to the movement axis of the piston, the spring has, however, a very soft characteristic, that is, a low rigidity or a low spring constant, so that the oscillations of the compression unit can be well adopted without being transferred to the housing. This is, however, exactly the direction, in which also the oscillations are generated. The higher rigidity of the spring exists in the x-direction and the y-direction, these directions defining the cross-section of the compression unit, whereas the rigidity in the z-direction, that is, the direction of the movement axis, is small. Usually, such a linear compressor is driven in a horizontal orientation, that is, with a horizontal movement axis. In this case, the spring has a high rigidity in the vertical direction, that is, also against the gravitational force, but a low rigidity in the direction of the movement axis.

It is preferred that the spring is made as a plane annular spring. Such a spring is easily manufactured. It is cost effective and has sufficiently good properties. Here, the term "plane" is not to be understood in the strict geometrical sense. Particularly at its ends, the annular spring can be deformed somewhat in relation to its plane.

It is preferred that a first end of the spring is connected to the housing and a second end of the spring is connected to the compression unit. The spring can, for example, be connected to the housing and the compression unit by means of welding. Thus, the complete length of the spring is utilised.

It is advantageous that in relation to the movement axis the first end and the second end are radially offset in relation to each other. Thus, the two ends do not collide. Accordingly the spring permits an oscillation of the compression unit along the movement axis. It is also ensured that the compression unit has a sufficient distance to the housing.

It is advantageous, when the spring is made as a spiral with one winding. Thus, the spring surrounds the compression unit on practically its complete circumference. This has the advantage that the fixing points of the spring on the compression unit and the housing can practically be located on a radial beam. This gives a favourable design.

It is preferred that in the gravity direction the spring is connected to the top of the housing and the compression unit. Thus, the compression unit is suspended in the housing. In this direction, the spring has the largest rigidity.

Preferably, the spring is arranged on the compression unit in an area of a diameter reduction. This gives an even better utilisation of the space available inside the housing. The compression unit can have a smaller distance to the housing than would be possible, when the spring would have to fit in all positions between the compression unit and the housing.

In a preferred embodiment, it is ensured that the spring is fixed on a support ring, which is inserted in the housing. In this case, the mounting is simpler. The spring can be fixed on the support ring and on the compression unit, and then the compression unit, provided with the support ring, can be inserted in the housing. Then the support ring is connected with the housing.

It is preferred that the spring is fixed axially on the support ring and/or on the compression unit. In this case, it is expedient to deflect at least the end sections of the spring somewhat axially from the plane of the spring. When the width of the spring is larger than the thickness, a larger surface is available for the fixing. Axial forces can be applied during the fixing, which is particularly advantageous with a welded joint.

Preferably, the support ring has an axial projection, which bears on the inside of the housing. The axial projection increases the stability of the housing.

Preferably, the projection is made to be annular. In this case, the housing is stiffened on its complete circumference.

Preferably, the spring arrangement has at least two curved springs, which have an axial distance to each other in relation to the movement axis. In this case, the compression unit is even better supported. Thus, it cannot tilt around a horizontal axis.

It is preferred that the springs have opposite winding directions. This will suppress possibly occurring torsional movements.

Preferably, the spring has a rectangular cross-section, a ratio of the radial extension b to the axial extension t in relation to the movement axis being at least 2:1. It has turned out that the rigidity of such a spring in the vertical direction is large enough, however, in the axial direction small enough.

BRIEF DESCRIPTION OF THE DRAWINGS

In the following, the invention will be described on the basis of a preferred embodiment in connection with the drawings, showing.

DETAILED DESCRIPTION OF THE INVENTION

Figure 1:
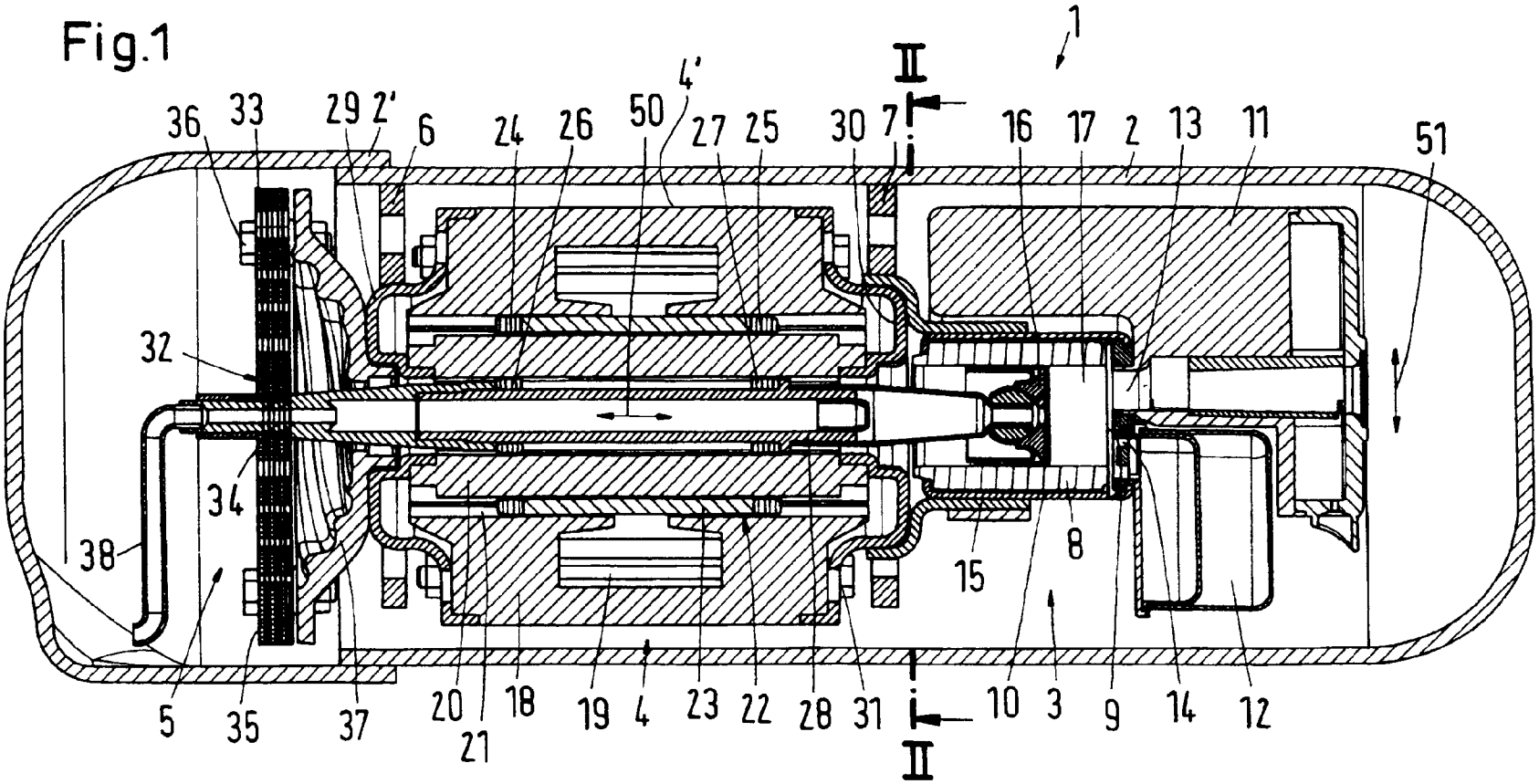
FIG. 1 is a schematic longitudinal section through a linear compressor.

FIG. 1 shows a linear compressor 1, which is located in a hermetically closed case 2, 2'.

The linear compressor 1 has a compression section 3, a drive section 4 and a resonance spring arrangement 5. The unit formed by compression section 3, drive section 4 and resonance spring arrangement 5 is suspended in the case 2 by means of two plane annular springs 6, 7 each being formed as a spiral with one winding. The annular springs 6, 7 are fixed in the drive section 4.

The compression section 3 has a cylinder 8, whose one end is covered by a cylinder head 9. The cylinder 8 and the cylinder head 9 are combined in a case 10 in the form of a cartridge. A suction muffler 11 and a pressure muffler 12 are fixed on the cylinder head 9. The suction muffler 11 is connected to a suction opening 13 and the pressure muffler 12 is connected to a pressure opening 14 in the cylinder head.

The case 10 is inserted in an intermediary ring 15, which is connected to the drive section 4. During mounting, the case 10 and thus the cylinder 8 can be displaced within certain limits in the axial direction of the cylinder in relation to the intermediary ring 15. When a predetermined position of the cylinder in relation to the drive section 4 has been reached, the case 10 is fixed in the intermediary ring 15, for example by welding, soldering or gluing.

In the cylinder 8 is located a piston 16, which borders a compression chamber 17 together with the cylinder 8 and the cylinder head 9.

The drive section 4 has a linear motor 4'. The linear motor has an outer stator 18 with a recess 19 for a winding, not shown in detail, and an inner stator 20. Between the outer stator 18 and the inner stator 20 is an annular gap 21, in which an armature 22 is movable. The armature 22 has permanent magnets 23, which are connected to each other by two rings 24, 25. The rings 24, 24 can, for example, be made of plastic. The rings 24, 25 are connected to inner rings 26, 27 by way of arms, not shown in detail, which are guided through slots in the inner stator 20.

The inner rings 26, 27 are connected to a piston rod 28, which again is connected to the piston 16.

The outer stator 18 and the inner stator 20 are connected to each other through motor covers 29, 30 that are clamped together by means of screw bolts 31. The screw bolts are guided in parallel with the movement direction of the piston rod 28.

The intermediary ring 15 is connected to the cylinder-side motor cover 30, for example by means of welding, gluing or soldering.

The resonance spring arrangement 5, which is located on an end of the drive section 4 being opposite to the compression section 3, has a spring pack 32 of several plate springs 33. The spring pack 32 is connected to the piston rod 28 in a central area 34. Via bolts 36, an outer section 35 of the spring pack 32 is connected to a stop housing 37 that forms a stop for the spring pack 32.

On the end projecting from the spring pack 32, the piston rod 28 is connected to an oil pump arrangement 38, which immerses in an oil sump, not shown in detail that forms in the bottom part of the case 2.

When the winding located in the recess 19 is energized, the armature 22 moves in one direction, taking the piston rod 28 along in this direction. When the direction of the current is reversed, the armature 22 with the piston rod 28 moves in the opposite direction, and accordingly moves the piston 16 in the opposite direction. Thus, the volume of the compression chamber 17 is periodically increased or reduced. The resonance spring arrangement 5 is adapted to the frequency of the current, so that the movable part of the linear compressor 1, which is formed by the armature 22, the piston rod 28, the piston 16, the oil pump arrangement 38 and the movable part of the resonance spring arrangement 5, oscillates in resonance.

During operation, the piston 16 and the armature 22 move along a movement axis 50. As a reaction to this, also the usually fixed part of the compression unit, namely the outer stator 18, the inner stator 20, the motor covers 29, 30, the cylinder 8 with the case 10 and the two mufflers 11, 12, will oscillate along the movement axis 50. This oscillation has a smaller amplitude than the oscillation of the piston 16 and the armature 22, as the mass of this part is larger than the mass of the moved parts with piston 16 and armature 22. However, it is still perceptible. Accordingly, the oscillation along the movement axis 50 must be prevented from transferring to the housing 2. In any case, oscillations along the movement axis 50 have to be severely damped.

In a direction perpendicular to the movement axis 50, that is, in a direction 51, and the plane defined by this, the risk of oscillations is substantially smaller. Here, it is endeavoured to arrange the compression unit with the smallest possible distance to the housing 2 to keep the dimensions of the housing 2 small.

Figure 2:
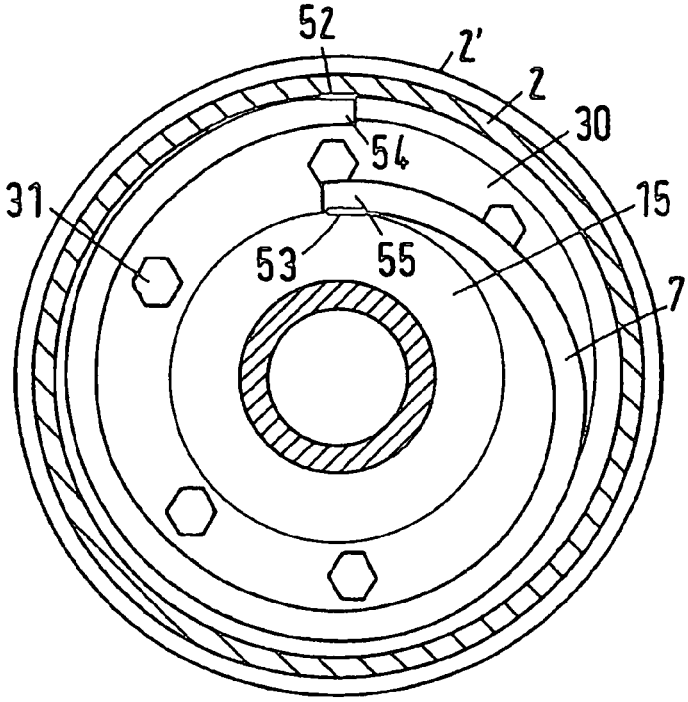
FIG. 2 is a section II-II according to FIG. 1.
Figure 3:
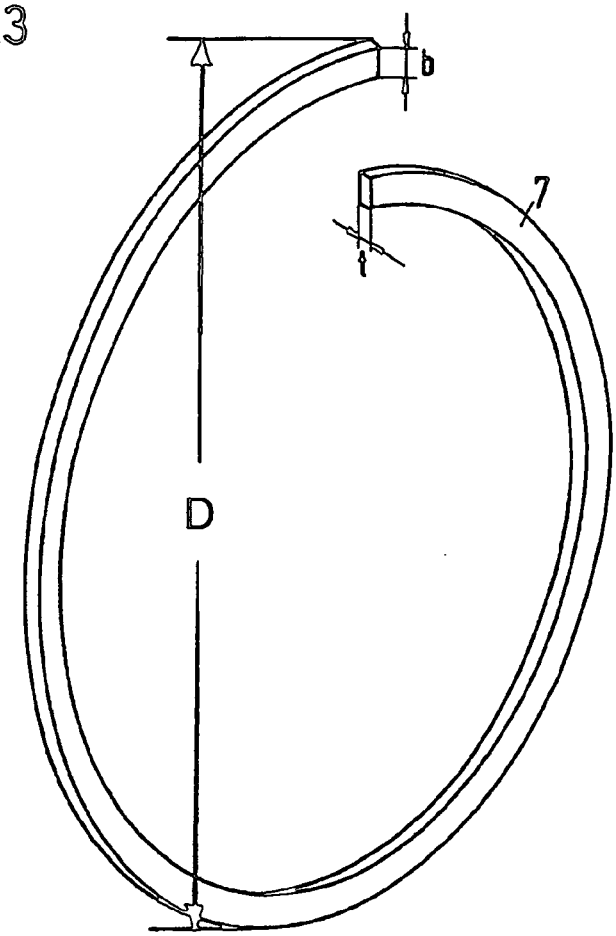
FIG. 3 is a perspective view of a spring.

In order, to meet these requirements, the two annular springs 6, 7, which will be explained in detail by means of FIGS. 2 and 3, are used to suspend the compression unit in the housing 2. The FIGS. 2 and 3 show the annular spring 7. The other annular spring 6 is made to be identical, however mounted with a different winding direction in the housing 2.

Same elements have the same reference numbers as in FIG. 1.

FIG. 2 shows the mounting situation of the annular spring 7, whose upper end is connected to the inner wall of the case 2 via a welded joint 52 and whose lower end is connected to the intermediary ring 15 via a welded joint 53. The other annular spring 6, however, is connected directly with the motor cover 29, where the motor cover has a diameter, which is smaller than the outer diameter of the outer stator 18.

The annular spring 7 is made as a spiral with one winding, which extends over an angle of somewhat more than 360°. The annular spring 7 is made of flat spring steel, whose thickness, that is, the extension t in the axial direction, is smaller than the width, that is, the extension b in the radial direction. The ratio b:t is 2:1.

Consequently, in the radial direction, for example in the vertical direction 51, the annular spring 7 has a substantially larger rigidity than in the direction of the movement axis 50. Accordingly, a displacement of the compression unit 3, 4, 5 along the movement axis 50 is possible; however a larger displacement in the radial direction 51 is reliably prevented by the annular springs 6, 7. Thus, the compression unit 3-5 is prevented from striking on the inside of the housing 2. As the compression unit 3-5 can oscillate in a relatively free manner along the movement axis 50, without striking on the housing 2, the oscillation will only be slightly trans-ferred to the housing 2.

The compression unit 3-5 is connected by the two annular springs 6, 7 to the housing 2 at two positions located at a distance from each other along the movement axis 50. The consequence of this is that the compression unit 3-5 cannot tilt in relation to the housing 2.

The two annular springs 6, 7 are mounted in the housing 2 with opposite orientation or winding direction. This counter-acts torsional torques, which could possibly occur in the compression unit 3-5.

The compression unit 3-5 is so to speak suspended in the housing 2, that is, the welded joint 52 is provided approximately at the uppermost position at the inner wall of the housing 2. In a similar manner, the welded joint 53 is provided vertically upon the motor cover 29 or on the intermediary ring, respectively.

The two ends 54, 55 of the annular spring 7 are offset in relation to each other in the radial direction. This means that, even though they overlap somewhat in the circumferential direction, they do not collide when the compression unit 3-5 oscillates along the movement axis 50.

Of course, it is also possible to use an annular spring 6, 7, whose length amounts to more than 360o. A longer spiral gives an even softer characteristic along the movement axis 50. However, additional space may be required in the vertical direction.

The cross-section of the annular spring 6, 7 can also be circular, square or have other shapes.

In an embodiment, in which the annular spring had one single winding and a rectangular cross-section with a width b=3 mm and a thickness t=1.5 mm and a largest diameter D=85 mm, a displacement of the compression unit 3-5 along the movement axis 50 of ±1 mm could be damped to a displacement of the housing of a few μm. Such oscillations are no longer noticeable in a disturbing manner.

Figure 4:
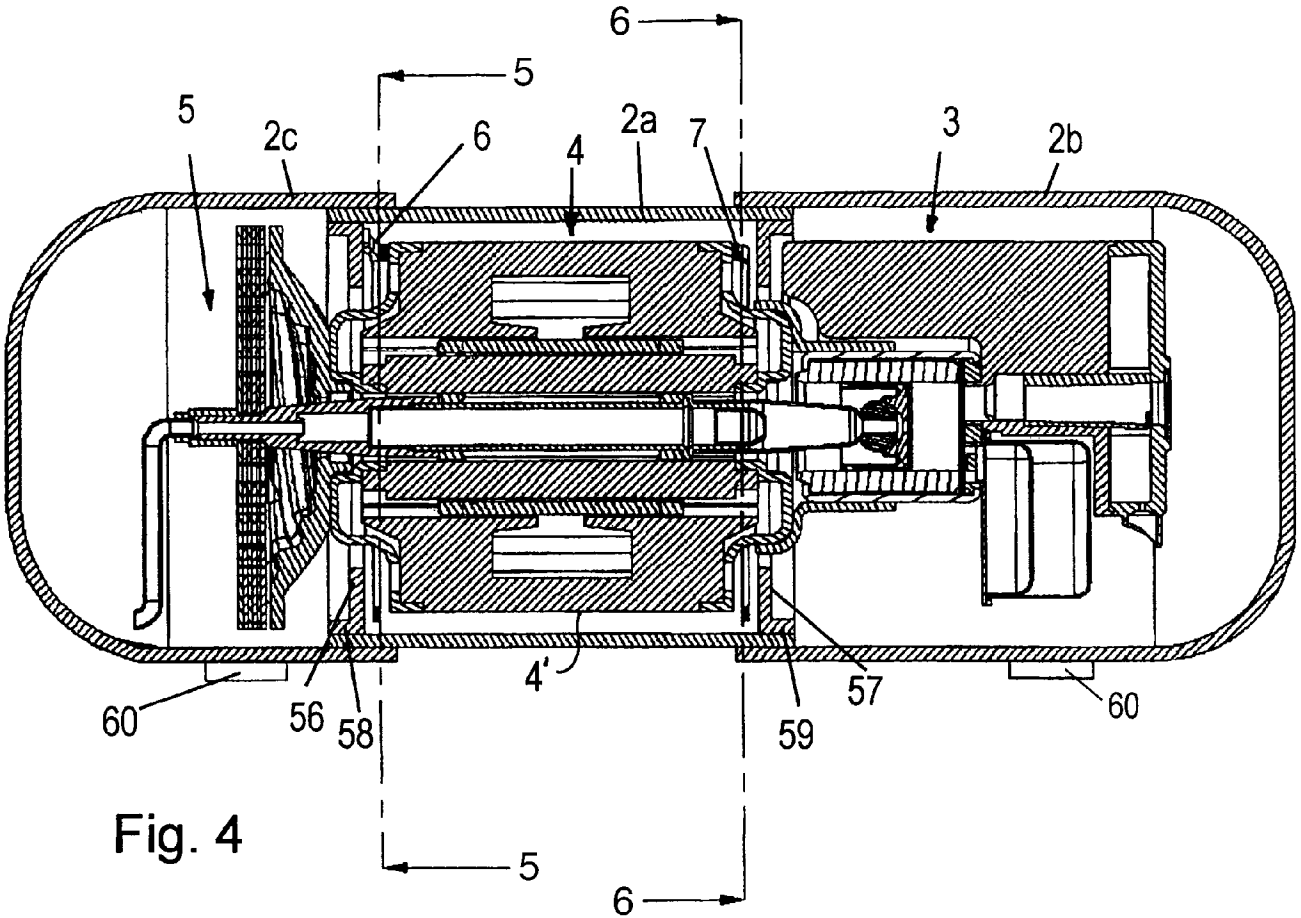
FIG. 4 is a schematic longitudinal section through a modified embodiment of a linear compressor.
Figure 5:
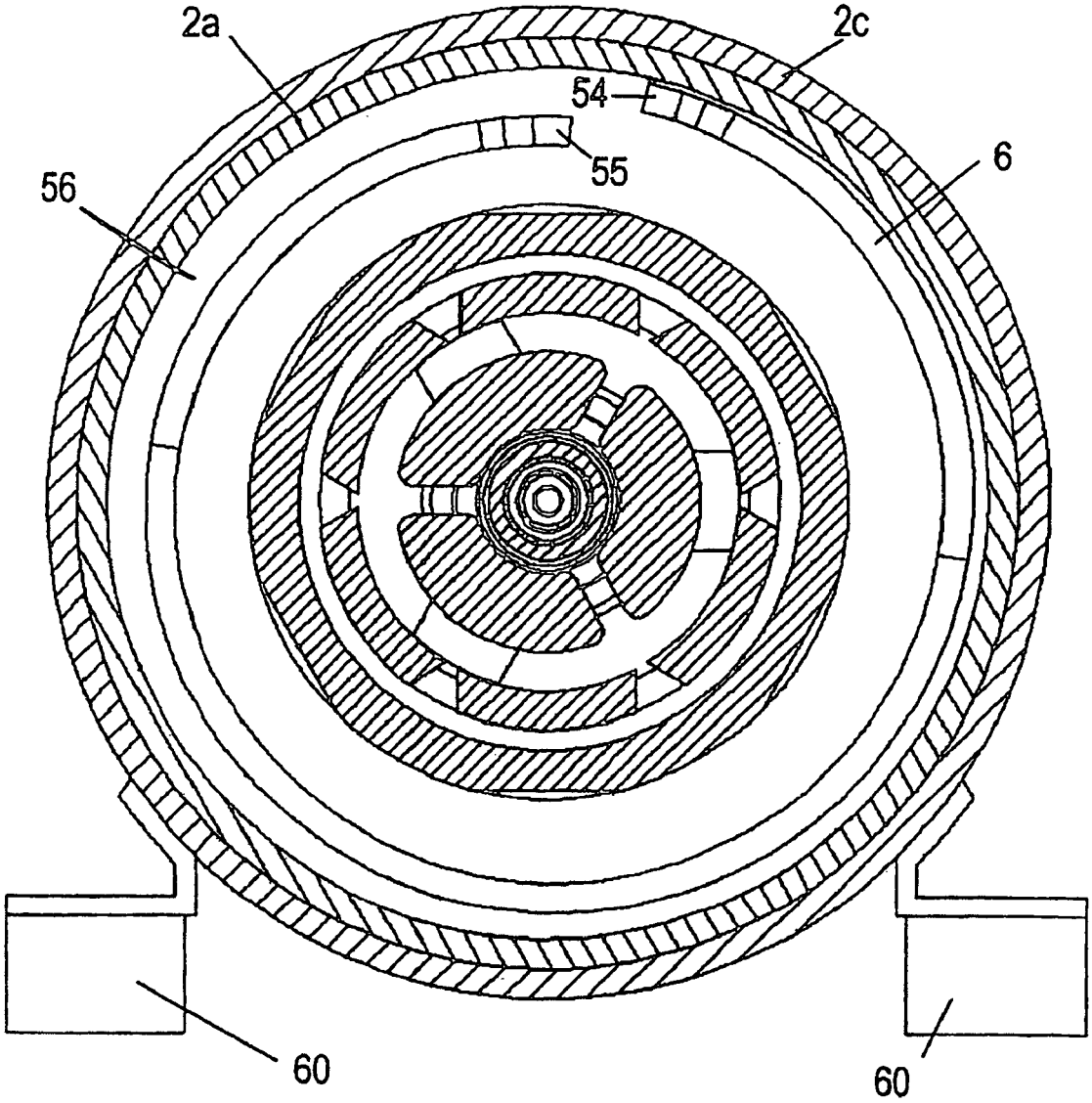
FIG. 5 is a section 5-5 according to FIG. 4.
Figure 6:
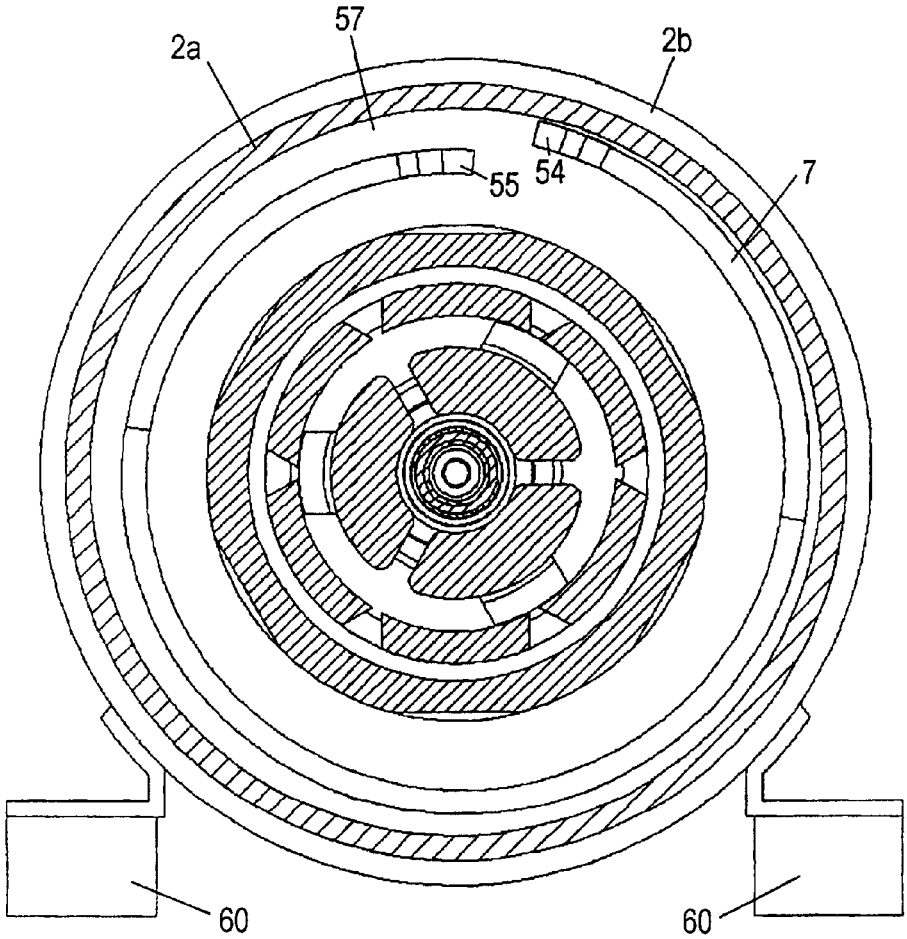
FIG. 6 is a section 6-6 according to FIG. 4.

FIG. 4 shows a modified embodiment of a linear compressor 1, in which the same elements have the same reference numbers.

The housing now has a middle section 2*a*, a case 2*b* surrounding the compression section 3 and a case 2*c* surrounding the resonance spring arrangement 5.

Figure 7:
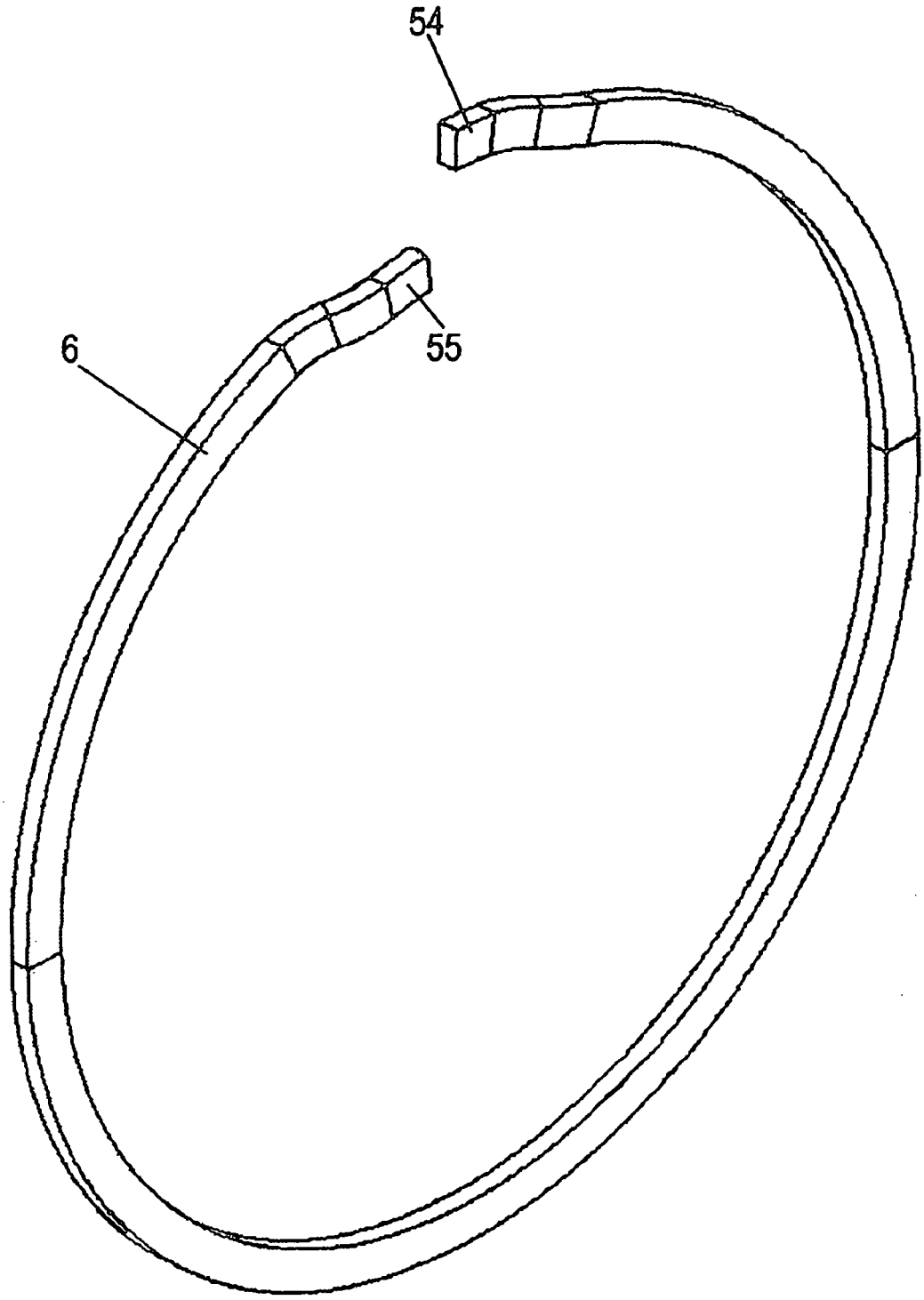
FIG. 7 is a perspective view of a modified embodiment of the spring.

As can be seen from FIG. 7, the annular springs 6, 7 are still substantially made to be flat. However, the first end section 54 is deformed slightly in one axial direction and the second section 55 is slightly deformed in the other axial direction. Thus, not only in the radial direction, but also in the axial direction the two end sections 54, 55 have a small distance to each other.

With this embodiment of the annular springs 6, 7 it is possible to fix the annular springs 6, 7 on support rings 56, 57 in the axial direction, that is, the axial end of each of the two end sections 54, 55 can be fixed on the support rings 56, 57 and on the motor covers 29, 30.

Each support ring 56, 57 has a circumferential annular flange 58, 59. Now, the annular springs 6, 7 can be fixed on the end of the drive section 4, for example by welding. As, in the radial direction, the annular springs 6, 7 extend over the drive section 4, the annular springs 6, 7 can subsequently be fixed on the support rings 56, 57 without problems, for example also by welding. Then the complete unit of compression section 3, drive section 4 and resonance spring arrangement 5 together with the support rings 56, 57 can be pushed into the middle section 2*a* of the housing and be fixed there. The fixing can, for example, be made at the same time as the fixing of the two cases 2*b*, 2*c* on the middle section 2*a*, for example by welding. Advantageously, the circumferential annular projections 58, 59 serve the purpose of increasing the overall stability of the housing.

Further, at the bottom of the housing 2 rubber elements 60 can be seen, with which the horizontally arranged linear compressor 1 can be placed on a base, not shown in detail.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A linear compressor comprising:

a housing, and a compression unit comprising a compressor with a piston and a cylinder as well as a linear motor for driving the piston in relation to the cylinder along a movement axis, wherein the compression unit is suspended within the housing via a spring arrangement connected to the linear motor, wherein the spring arrangement comprises a spring which is curved in the circumferential direction in relation to the movement axis, said spring surrounding the compression unit on at least a share of its circumference, wherein the piston is not directly connected to the housing, wherein a first end of the spring is connected to the housing, and a second end of the spring is connected to the linear motor, wherein the first end is located at a different radial distance from the movement axis than the second end, and wherein the spring is made as a spiral with one winding.

2. The linear compressor according to claim 1, wherein the spring is made as a plane annular spring.

3. The linear compressor according to claim 1, wherein in the gravity direction the spring is connected to the top of the housing and to the compression unit.

4. The linear compressor according to claim 1, wherein the spring is arranged on the compression unit in an area of a diameter reduction.

5. The linear compressor according to claim 1, wherein the spring is fixed on a support ring, which is inserted in the housing.

6. The linear compressor according to claim 5, wherein the spring is fixed axially on the support ring and/or on the compression unit.

7. The linear compressor according to claim 6, wherein the support ring has an axial projection, which bears on the inside of the housing.

8. The linear compressor according to claim 7, wherein the projection is made to be annular.

9. The linear compressor according to claim 1, wherein the spring arrangement has at least two curved springs, which have an axial distance to each other in relation to the movement axis.

10. The linear compressor according to claim 9, wherein the springs have opposite winding directions.

11. The linear compressor according to claim 1, wherein the spring has a rectangular cross-section, a ratio of the radial extension b to the axial extension t in relation to the movement axis being at least 2:1.

12. A linear compressor with a housing unit and a compression unit, which comprises a compressor with a piston and a cylinder as well as a linear motor driving the piston in relation to the cylinder along a movement axis, the compression unit being suspended within the housing unit via a spring arrangement, wherein the spring arrangement comprises a spring, which is curved in the circumferential direction in relation to the movement axis and is connected to the housing unit and to the linear motor, said spring surrounding the compression unit on at least a share of its circumference, wherein said spring is at least partially adjacent to said housing unit, wherein the piston is not connected to the housing unit, wherein a first end of the spring is connected to the housing, and a second end of the spring is connected to the linear motor, wherein the first end is located at a different radial distance from the movement axis than the second end, and wherein the spring is made as a spiral with one winding.

13. The linear compressor according to claim 12, wherein the spring is a plane annular spring.

14. The linear compressor according to claim 12, wherein the spring has a rectangular cross-section, and wherein a ratio of the radial extension b to the axial extension t in relation to the movement axis is at least 2:1.

15. A linear compressor, with a housing and a compression unit, which comprises a compressor with a piston and a cylinder as well as a linear motor driving the piston in relation to the cylinder along a movement axis, the compression unit being suspended within the housing via a spring arrangement, wherein the spring arrangement comprises a spring, which is curved in the circumferential direction in relation to the movement axis and is connected to the housing and to the linear motor, said spring surrounding the compression unit on at least a share of its circumference, wherein said spring is a plane annular spring, wherein the piston is not connected to the housing, wherein a first end of the spring is connected to the housing, and a second end of the spring is connected to the linear motor, wherein the first end is located at a different radial distance from the movement axis than the second end, and wherein the spring is made as a spiral with one winding.

16. The linear compressor according to claim 15, wherein the spring has a rectangular cross-section, and wherein a ratio of the radial extension b to the axial extension t in relation to the movement axis is at least 2:1.

* * * * *